US007001285B1

(12) United States Patent
Ahrend

(10) Patent No.: US 7,001,285 B1
(45) Date of Patent: Feb. 21, 2006

(54) GOLF SWING TRACKING DEVICE

(75) Inventor: Todd W. Ahrend, Tulsa, OK (US)

(73) Assignee: Tracker Golf LLC, Tulsa, OK (US)

( * ) Notice: Subject to any disclaimer, the term of this patent is extended or adjusted under 35 U.S.C. 154(b) by 0 days.

(21) Appl. No.: 10/934,896

(22) Filed: Sep. 3, 2004

Related U.S. Application Data

(63) Continuation-in-part of application No. 10/347,670, filed on Jan. 20, 2003, now Pat. No. 6,786,833.

(51) Int. Cl.
*A63B 69/36* (2006.01)

(52) U.S. Cl. ..... 473/265; 473/257; 473/261

(58) Field of Classification Search ..... 473/257, 473/261, 262, 263, 264, 265, 251, 252, 253, 473/258, 260, 278
See application file for complete search history.

(56) References Cited

U.S. PATENT DOCUMENTS

| | | | | |
|---|---|---|---|---|
| 1,383,876 | A | | 7/1921 | Sullivan |
| 1,532,984 | A | | 4/1925 | Borthwick |
| 2,152,381 | A | | 3/1939 | Harpster |
| 2,712,939 | A | | 7/1955 | Harp |
| 2,801,857 | A | | 8/1957 | Strunk |
| 3,107,920 | A | | 10/1963 | Strunk |
| 3,113,780 | A | | 12/1963 | Livingstone |
| 3,194,565 | A | | 7/1965 | Schroer |
| 3,675,927 | A | * | 7/1972 | Gottlieb et al. ..... 273/119 A |
| 3,741,550 | A | | 6/1973 | Laudures |
| 3,894,739 | A | | 7/1975 | Goldstein |
| 4,180,270 | A | | 12/1979 | Long |
| 4,465,281 | A | | 8/1984 | Whitfield |
| 4,526,373 | A | | 7/1985 | Medlock |
| 4,732,390 | A | | 3/1988 | McCollum |
| 4,913,440 | A | | 4/1990 | Ellington |
| 5,263,719 | A | | 11/1993 | Bunn |
| 5,350,177 | A | | 9/1994 | Furbush, Jr. |
| 5,855,523 | A | | 1/1999 | Hatchett |
| 5,961,393 | A | | 10/1999 | Heller et al. |

* cited by examiner

*Primary Examiner*—Nini F. Legesse
(74) *Attorney, Agent, or Firm*—Head, Johnson & Kachigian

(57) ABSTRACT

A golfing aid comprising a guide structure in the form of a base member with a plurality of swing deviation indicators pivotally mounted thereon with the indicators positioned on opposite sides of a desired area defining an intended club head swing path, the deviation indicators are each yieldably mounted in a manner to allow a responding rotation upon being struck by a club head deviating from the intended club head swing path.

6 Claims, 4 Drawing Sheets

GOLF SWING TRACKING DEVICE

REFERENCE TO PENDING APPLICATIONS

This application is a continuation-in-part application claiming benefit from U.S. patent application Ser. No. 10/347,670, now U.S. Pat. No. 6,786,833 filed Jan. 20, 2003, entitled "A Golf Swing Tracking Device".

REFERENCE TO MICROFICHE APPENDIX

This application is not referenced in any microfiche appendix.

TECHNICAL FIELD OF THE INVENTION

In general, the invention relates generally to the field of golf practice devices and in particular to those devices equipped with swing deviation indicators to visually display deviations from a desired path of golf club head travel.

BACKGROUND OF THE INVENTION

Golf practice devices of the general type are not new. See, for example, U.S. Pat. Nos. 3,018,109, 3,107,920 and 3,113,780. In all instances of these devices, however, a great impact force exerted on knockdown pegs by a golf club swung without restraint has made it extremely difficult to prevent uprooting of the pegs and to insure a reasonably long useful life for the device.

The art enhancing teachings of the instant invention discuss, disclose and claim swing deviation indicators which are reliably rotated on a pivot means to visually indicate an improper swing and are resilient enough to withstand repeated club head impact. The instant invention's swing deviation indicators allow rapid return to an original swing monitoring position by avoiding the deficiencies of prior art teachings in which upright indicator are struck in an attempt to visually indicate a desired golf club swing path. The instant invention improves upon the art by providing the requisite degree of accuracy in terms of golf swing direction while further avoiding the deficiencies of the prior art wherein vertically oriented knockdown pegs have been utilized and found extremely difficult to uproot and reposition.

Other objects and further scope of the applicability of the present invention will become apparent from the detailed description to follow, taken in conjunction with the accompanying drawings wherein like parts are designated by like reference numerals.

BRIEF SUMMARY OF THE INVENTION

A golfing aid comprising a guide structure in the form of a base member with a plurality of swing deviation indicators pivotally mounted thereon with the indicators positioned on opposite sides of a desired area defining an intended club head swing path, the deviation indicators each yieldably mounted in a manner to allow responding rotation upon being struck by a club head deviating from said intended club head swing path.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
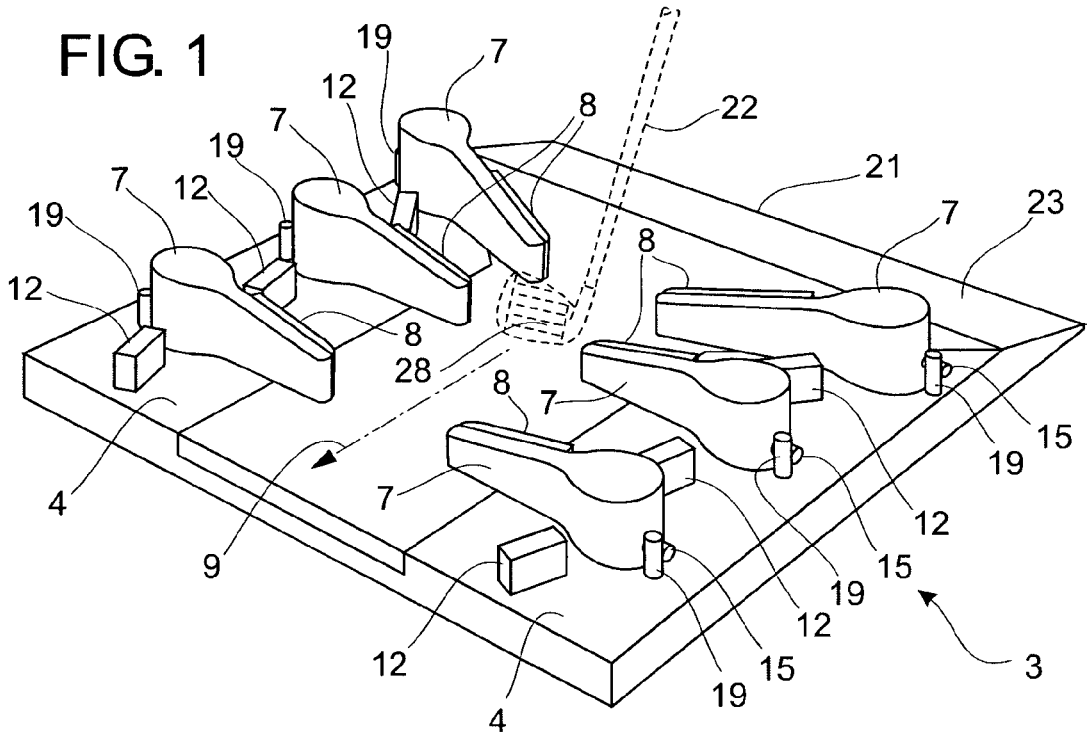
FIG. 1 is an illustration of the instant invention when viewed from a first end and discloses a golf club (in phantom) positioned upon an area defining an intended club head swing path.

FIG. 1 is an illustration of the instant invention when viewed from a first end and discloses a golf club (in phantom) positioned upon desired area defining an intended club head swing path. Turning now to FIG. 1.

In FIG. 1 the golfing aid of the instant invention is generally referred to as element 3 and comprises a base member 4 with a plurality of swing deviation indicators 7 pivotally mounted thereon with the indicators 7 positioned on opposite sides of a desired area defining an intended golf club swing path 9. The means of pivoting the first member upon a rotational axis is widely known and practiced. As used herein, the term "pivot" is intended to refer to and encompass all pivoting means which would allow a rotation of a deviation indicator 7 along an axis which would denote, and easily present visually, an indication of said deviation indicator 7 having been struck by a golf club head 28. Though variations of such pivoting means would contemplate and include bearings and ornate axle assemblies, the present invention may be practiced most efficiently utilizing a simple peg-like structure upon which a hollowed out portion of the underside of a deviation indicator 7 may be positioned. The deviation indicators 7 each are yieldably mounted in a manner to allow responding rotation upon being struck by a club head 28 deviating from the intended club head swing path 9. Also shown in FIG. 1 are limitation blocks 12 which restrict the range of rotation of one or more deviation indicators 7. Each of the indicators 7 further comprises a first positioning peg 15 that works in concert with a second positioning peg 19 affixed to the base member 4 to guidably reposition the deviation indicator 7 after being struck by a club head 28 when deviating from the intended club head swing path 9. The deviation indicator 7 further comprise a resilient club head striking surface 8 typically comprised of, though not limited to, a rubber-based or polyurethane-based substance sufficient to absorb repeated impact of the golf club head 28 when deviating from intended swing path 9.

Continuing with the description of FIG. 1, the invention is also shown at one end, an area of incline 23 which allows the traversing thereupon of a golf ball (not shown in FIG. 1) with the inclined area extending from a floor level 21 to base member surface area 4 upon which a golf ball is positioned in anticipation of being struck by golf club head 28. Further discussion and disclosure with respect to the positioning of said golf ball provided in association with FIGS. 4 and 5. To approximate the conditions of an actual striking/playing surface, the inclined area 23 and/or golf club intended swing path area 9 may include a grass-like surface which covers portion routinely making contact with a golf ball when practicing the invention. Such grass-like surfaces are well known to those skilled in the art and are typically associated with trade names, such as Astroturf indoor/outdoor carpeting, etc.

Figure 2:
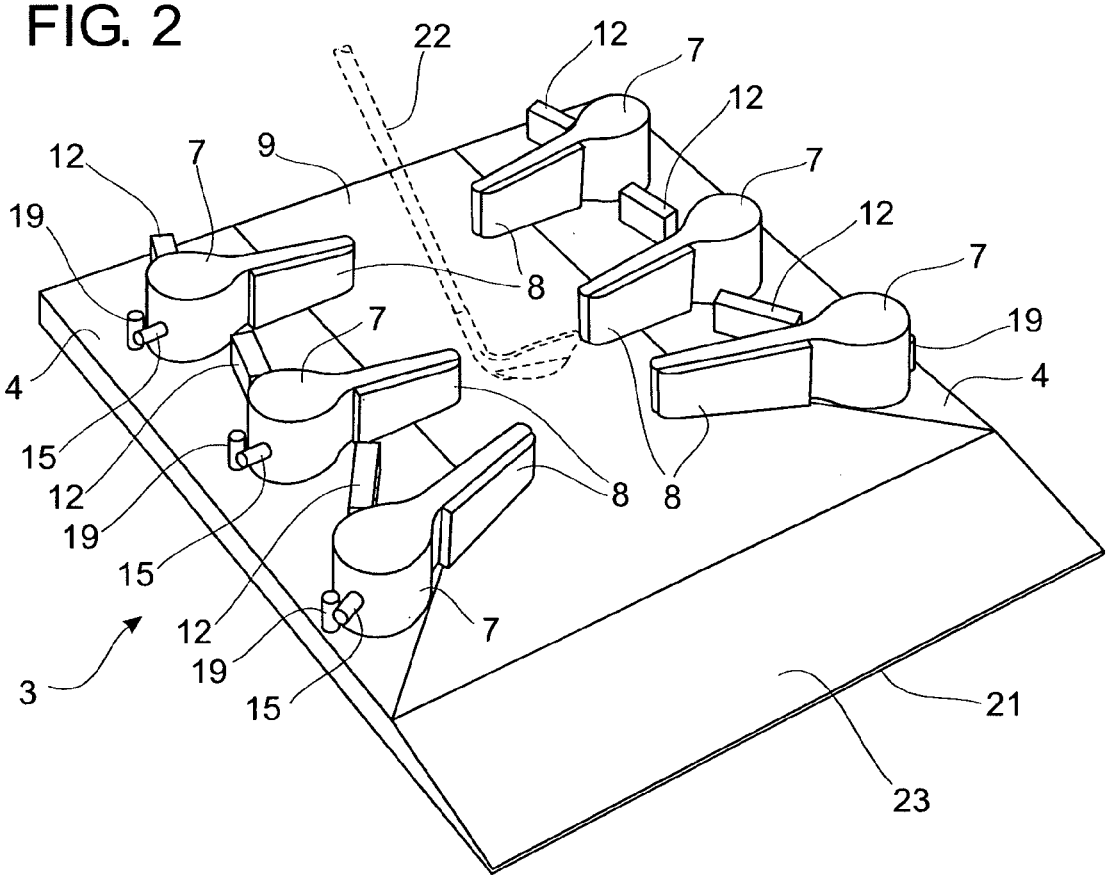
FIG. 2 is an illustration of the instant invention of FIG. 1 when viewed from an end opposite that illustrated in FIG. 1.

FIG. 2 illustrates an opposite view of the invention of FIG. 1 and consistent disclosure is immediately provided wherein the golfing aid of the instant invention is generally referred to as element 3 and comprises a guide structure in the form of a base member 4 with a plurality of swing deviation indicators 7 pivotally mounted thereon with the indicators 7 positioned on opposite sides of a desired area defining an intended golf club swing path 9. The deviation indicators 7 each are yieldably mounted in a manner to allow responding rotation upon being struck by a club head 28 deviating from the intended club head swing path 9. Also shown in FIG. 2 are limitation blocks 12 which restrict the range of rotation of one or more deviation indicators 7. Each of the indicators 7 further comprises a first positioning peg 15 that works in concert with a second positioning peg 19 affixed to the base member 4 to guidably reposition the deviation indicator 7 after being struck by a club head 28 when deviating from the intended club head swing path 9. The deviation indicator 7 further comprise a resilient club head striking surface 8 typically comprised of though not limited to a rubber-based or polyurethane-based substance sufficient to absorb the impact of the golf club head 28 when deviating from the intended swing path 9.

Figure 3:
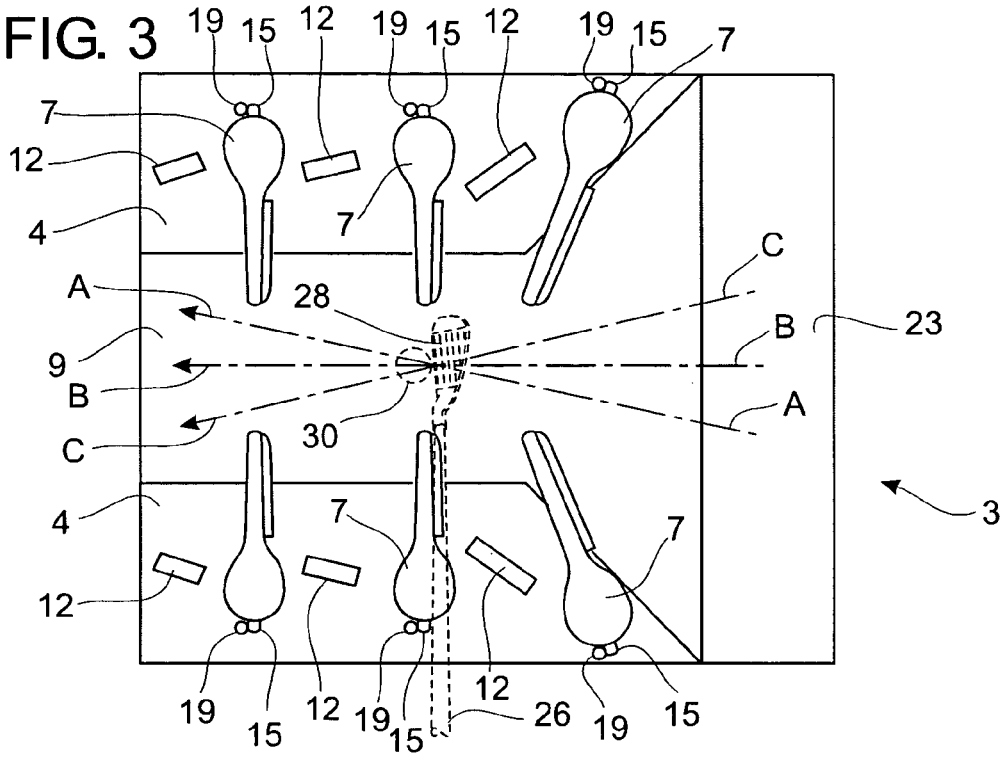
FIG. 3 is an illustration of the instant invention further illustrating placement of a golf ball and golf club in phantom and indicating potential swing paths of the club head when attempting to make contact with the golf ball.

FIG. 3 is an illustration of the instant invention further illustrating a placement of a golf ball and golf club in phantom and indicating potential swing paths of the club head when attempting to make contact with the golf ball. Turning now to FIG. 3.

In FIG. 3 it is observed and disclosed where potential lines of golf swing are indicated as lines A, B and C. Also indicated in FIG. 3 is ball 30, golf club shaft 26 and golf club head 28. A golfer intending to strike golf ball 30 and cause it to move along lines A, B or C would be successful in precipitating such movement if contact is made between the golf head 28 and golf ball 30 without striking any of the deviation indicators 7.

Figure 4:
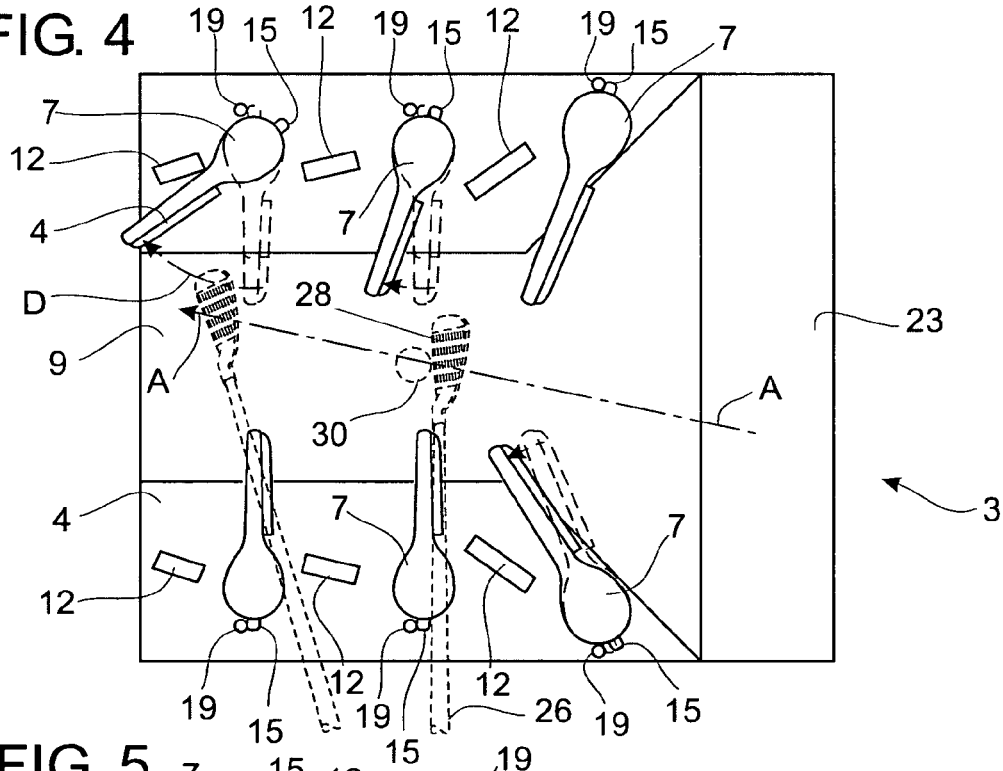
FIG. 4 is an illustration of the instant invention showing the golf club head making contact with a golf ball along a swing path illustrated as line A and causing a deviation indicator to be rotated or otherwise moved along line D.

FIG. 4 illustrates an intended golf practice swing along line A wherein one such deviation indicator has been moved to denote deviation from the intended line of swing. Turning now to FIG. 4.

In FIG. 4 the golf club head 28 is seen striking ball 30 with the intent to cause ball 30 to travel along line A. However, in continuing the golf swing, it is further shown where golf club head 28 deviates sufficiently from the intended swing path to cause contact to be made with left uppermost deviation indicator 7 causing said deviation indicator 7 to move along line D thus providing visual representation of force and scope of swing deviation from intended swing path line A.

Figure 5:
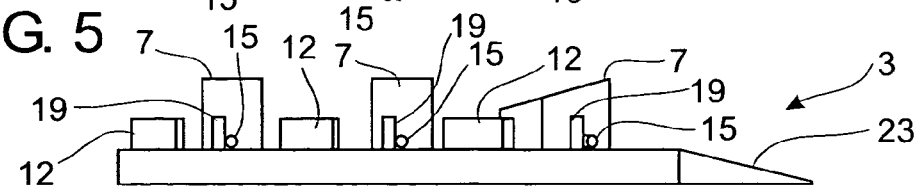
FIG. 5 is a side view illustration of the instant invention illustrating the invention's base member, deviation indicators and pegs.

FIG. 5 illustrates a side view illustration of the invention. Turning now to FIG. 5.

In FIG. 5 it is seen where the base member 4 is shown with pivotally mounted deviation indicators 7. Further illustrated in FIG. 5 are the limitation blocks 12 of the instant invention which limit the responding rotational travel of deviation indicator upon being struck by a golf club head deviating from an intended swing path. Lastly, illustrated in FIG. 5 are the invention's first positioning peg 15 and second positioning peg 19 with said positioning peg 19 mountably affixed to the golf base member 4 and the first positioning peg insertably mounted or otherwise affixed to swing deviation indicator 7.

Figure 6:
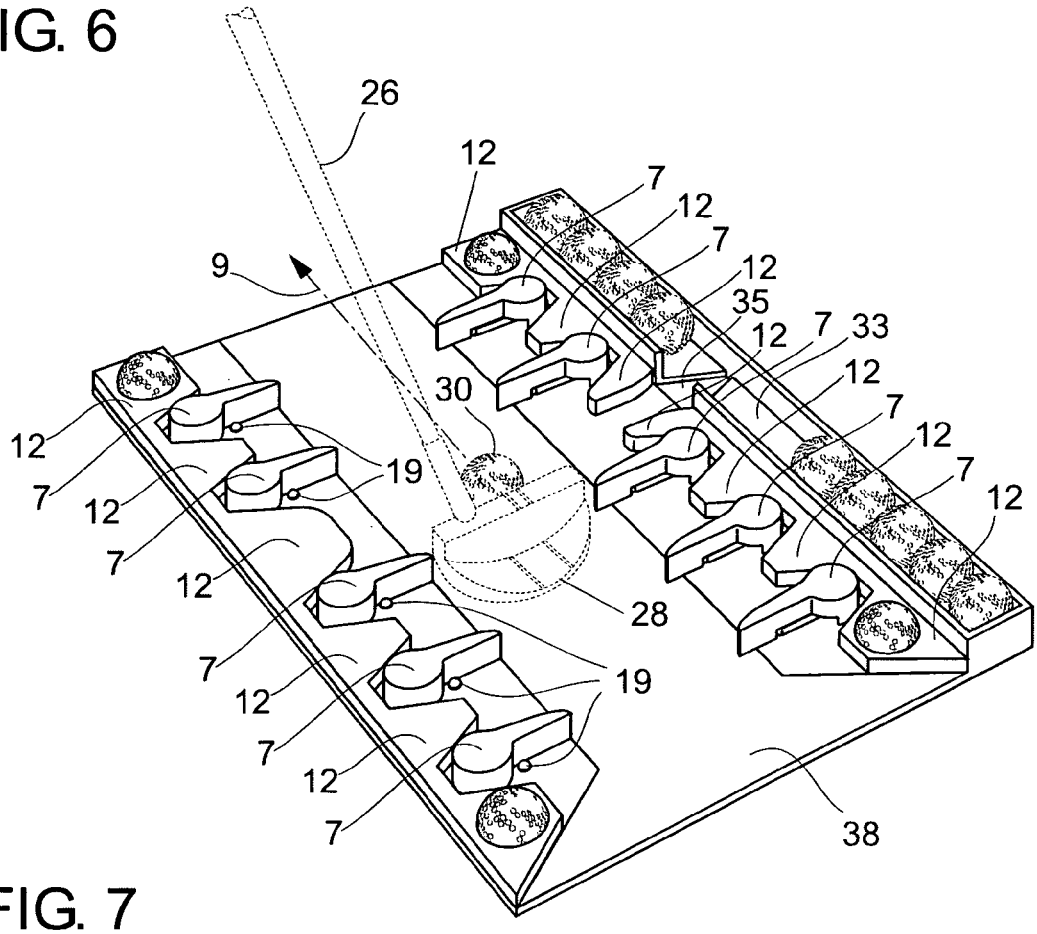
FIGS. 6 and 7 illustrate a readily envisioned alternative embodiment of the instant invention wherein the embodiment is constructed out of a moldable material, such as, but not limited to, plastic or polyurethane based material.

FIG. 6 illustrates a readily envisioned alternative embodiment of the instant invention wherein it is disclosed that the limitation blocks 12 are integrated as part of a uni-body molded structure and preclude excessive rotational travel of deviation indicators 7 as described in association with FIGS. 1 through 5. Further illustrated in FIG. 6 is a golf ball storage area 33 where a golf ball 37 may be stored and rotated or otherwise transported to an inclined ramp 35 whereupon said golf ball 37 would roll down said ramp 35 to the surface area 38 of the invention prior to being positioned as being indicated in 30 for subsequent striking by a golf club head 28 which is attached to a golf club shaft 27. In FIG. 6, element 9 indicates an intended golf club head swing path with the embodiment illustrated in FIG. 6 intended and used most efficiently with utilization of a putter in hopes of improving a golfer's putting stroke. Said golf club head 28 in FIG. 6 is intended to represent a putter golf club head. Also indicated in FIG. 6 are a plurality of second positioning pegs 19 which work in concert with said deviation indicator 7 to allow original positioning prior to practicing the instant invention in an effort to improve ones putting/golf club swing.

Figure 7:
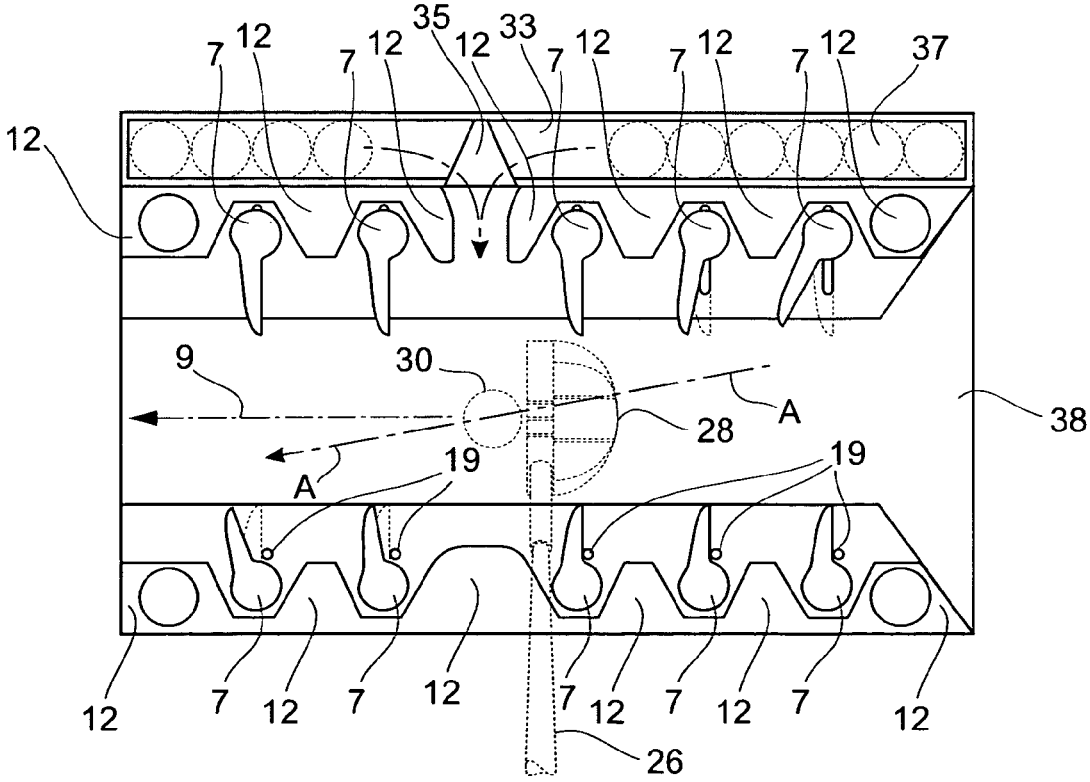

FIG. 7 illustrates a deviated golf club swing from an intended golf club swing path in association with the alternative embodiment of FIG. 6. Turning now to FIG. 7.

In FIG. 7 it is intended that golf club head 28 should follow and drive a golf ball along line 9. However, as indicated in FIG. 7, golf club head 28 is shown moving along the line A and striking or otherwise making contact with deviation indicator 7 in the lowermost left corner of the embodiment of FIG. 7. FIG. 7 further provides clarity with respect to the ramp 35 whereupon a golf ball 37 may be rotated or otherwise moved to allow its descending to surface 38 whereupon it may be positioned as indicated in 30 in anticipation of being struck by golf club head 28.

Figure 8:
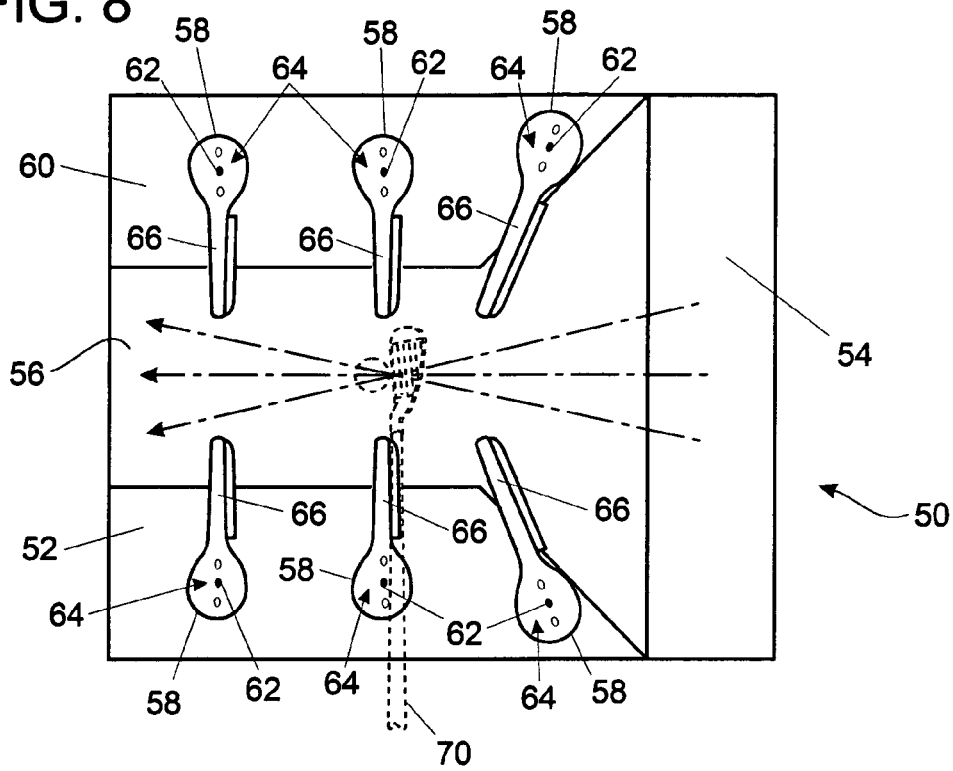
FIG. 8 is a top plan view of an alternative embodiment of the present invention.
Figure 9:
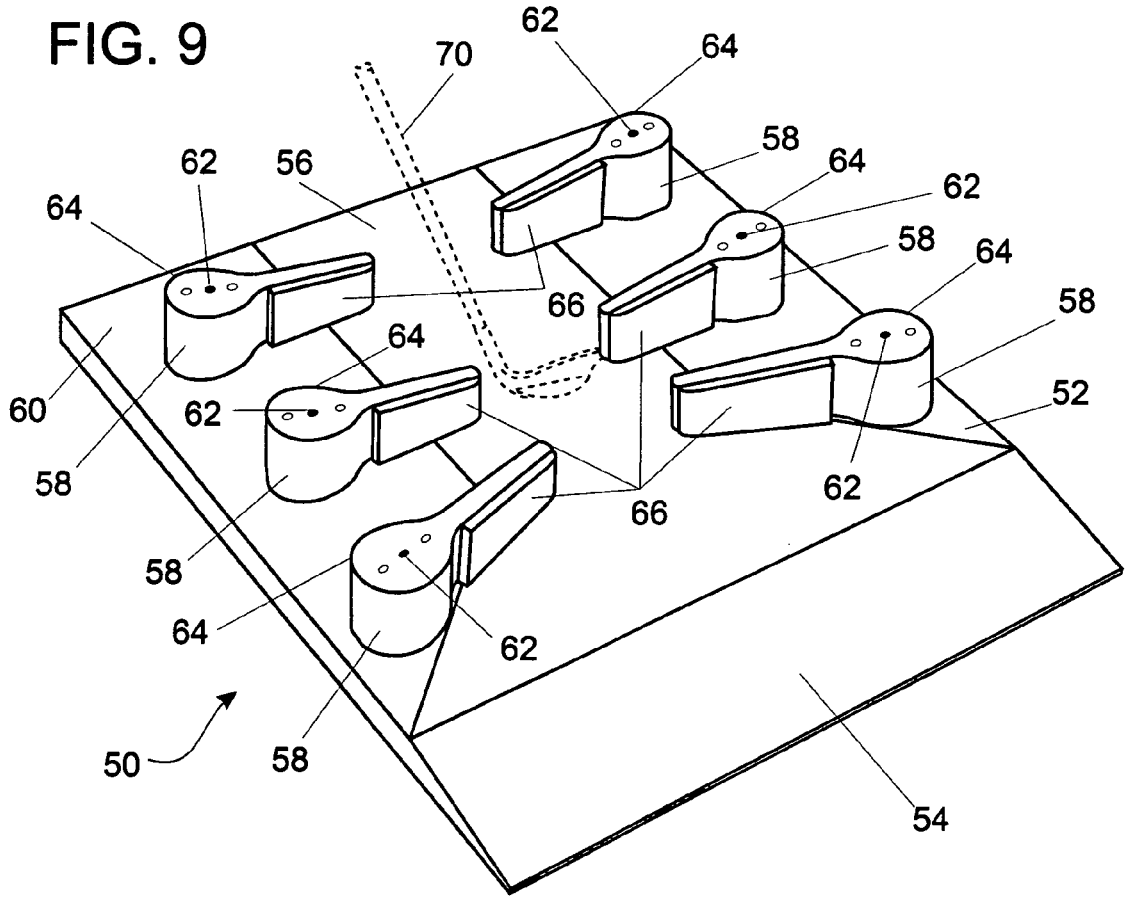
FIG. 9 is a perspective view of an alternative embodiment of the present invention.

FIGS. 8 and 9 show an alternative embodiment of the present invention. Golf swing tracking device 50 comprises a base 52 having an inclined region 54 to aid in rolling a golf ball onto the swing path portion 56 of the device. Inclined region 54 is optional but preferable. Swing deviation indicators 58 are pivotally mounted to base 60 by means of pivot pins 62. Pivot pins 62 may be placed in one of a series of pivot holes 64 located on each swing deviation indicator 58. In the embodiment shown in FIGS. 8 and 9, each indicator 58 has three pivot holes 64. However, each indicator may have as few as one pivot hole or several pivot holes. By having a plurality of pivot holes 64, the indicator may be adjusted so that the arm 66 extends further into or less into swing path 56. Indicators 58 are typically pivotally attached to base 60 only by pivot pins 62. This allows for free rotation about a pivot pin 62. However, it may be desirable for various dampening mechanisms to be employed to adjust the amount of force required to cause the indicators to rotate. Preferably, any dampening mechanisms are adjustable to control the amount of force or torque required to rotate one of the indicators.

Indicators 58 as well as base 60 may be comprised of any suitable material. Swing path 56 is preferably coated with Astroturf but this is not necessary. If indicators 58 are comprised of a particularly hard material, it may be preferable to coat arms 66 with an elastic or softer material so as to prevent damage to a golf club 70 shown in phantom.

The embodiment shown in FIGS. 8 and 9 do not include limitation blocks, allowing some or all of indicators 58 to rotate an entire 360° about pivot pins 62. By utilizing a dampening mechanism on indicators 58, the force applied to each indicator by an incorrect golf swing may be measured by the amount of rotation of the indicator 58.

It will of course be understood that various changes may be made in form, details, arrangement and proportions of the apparatus without departing from the scope of the invention, which generally stated consists of an apparatus capable of carrying out the objects above set forth, in the parts and combination of parts as disclosed and defined in the appended claims.

What is claimed is:

1. A golfing aid comprising:

a base having a first side and a second side and having a plurality of upward protruding pivot pins on the first side and the second side;

a plurality of swing deviation indicators;

wherein at least one of the plurality of indicators is pivotally mounted on the first side of the base and at least one of the indicators is pivotally mounted to the second side of the base.

2. The device of claim 1 wherein the swing deviation indicators have a plurality of pivot holes by which they may be pivotally removably attached to the base.

3. The device of claim 1 wherein the swing path is coated with artificial grass.

4. The device of claim 1 wherein the indicators are comprised of a material selected from the group consisting of ceramic, wood, plastic, rubber and a metal alloy.

5. The device of claim 4 wherein the indicators are coated with a soft material.

6. The device of claim 1 wherein the base further comprises a dampening mechanism for adjusting the amount of torque required to rotate the indicators about the pivot pins.

* * * * *